United States Patent [19]

Delisle

[11] Patent Number: 4,854,105

[45] Date of Patent: Aug. 8, 1989

[54] ROOFING MEMBRANE ANCHOR

[76] Inventor: Roger L. Delisle, 125 S. Gray St., Manchester, N.H. 03103

[21] Appl. No.: 192,204

[22] Filed: May 10, 1988

[51] Int. Cl.[4] ..... E04B 1/38

[52] U.S. Cl. ..... 52/698; 52/410; 52/222; 52/512

[58] Field of Search ..... 52/63, 222, 410, 506, 52/512, 713, 698

[56] References Cited

U.S. PATENT DOCUMENTS 4,617,771 10/1986 Tomaszewski ..... 52/512 X 4,651,490 3/1987 Marston ..... 52/410

*Primary Examiner*—David A. Schrebel

*Assistant Examiner*—Jerrold D. Johnson

*Attorney, Agent, or Firm*—Davis, Bujold & Streck

[57] ABSTRACT

An anchor for releasably anchoring a membrane to a surface housing a base member for attachment to the surface, the base member including a post having a groove therearound, and a fastening assembly shaped to freely fit over the base member with the membrane thereover, the fastening assembly including a fastening ring, housed in ring fastening member, capable of inward deformation to cooperate with the groove with the membrane therebetween to captively hold the assembly on the base member and a deforming member to deform the fastening ring inwardly into that cooperation and to maintain that cooperation.

4 Claims, 3 Drawing Sheets

ROOFING MEMBRANE ANCHOR

BACKGROUND OF THE INVENTION

The present invention relates to anchors for membranes and, more particularly, to an anchor for releasably anchoring a membrane to a surface comprising, a base member including means for attaching the base member to the surface, the base member including a post having an annular groove smaller in inner diameter than the diameter of the top of the post; and a three part fastening assembly, comprising a fastening member, a fastening ring and a ring deforming member, shaped to fit over the base member with the membrane therebetween, wherein with the membrane deformed over the post, the deforming member forces the ring inwardly to press and hold the membrane in the groove.

A fairly recent development in the commercial roofing art has made it possible, by the use of contemporary materials having suitable qualities, to cover roofs with a continuous sheet of water resistant membrane material. The membrane sheet is not adhesively attached to the roof surface as with prior art tar-paper, and the like. Rather a plurality of spaced anchor bottoms are first attached to the roof. The membrane is then spread over the anchor bottoms and anchor tops attached over the membrane to the anchor bottoms thus attaching the membrane to the roof at the anchor points.

In general prior art devices require the forceful installation of the primary membrane retainer before final engagement is complete. This forceful fit of retainer pieces on the membrane causes damage to the membrane.

The anchors to date have been generally of a standard construction with several variations. The basic approach is shown in FIG. 1 and, in general, represents the approach of U.S. Pat. Nos. Francovitch (4,631,887); Baginski (4,624,092); Hahn (4,506,256); and Fischer (4,211,028). In this approach, there is a bottom portion 10 comprising a circular base 12 having a round center post 14 extending upward therefrom. The post 14 can be mushroom shaped as shown in the figure or simply flare outward towards the top as in other approaches to be described shortly. The bottom portion 10 has a longitudinal bore through the post 14 and base 12 though which a screw 16, or the like, is placed to fasten the bottom portion 10 to the roof 18. The membrane 20 is disposed over the bottom portion 10 and held in place by a retaining clip of some kind, such as the cap 22 of FIG. 1, which creates a gripping force under the flared top of the post 14 as indicated by the arrows 24.

While the basic approach of FIG. 1 works and is simple to construct, it has problems. With respect to the specific prior art approach represented by FIG. 1, what snaps on easily also snaps off easily. Thus, in any kind of high wind situation creating reasonably high lifting forces on the membrane, the caps 22, or the like, simply snap off releasing the membrane with appreciable disasterous results. Thus, anchors incorporating an ability to lock the components together were developed. One approach is shown in FIG. 2 which represents the teaching of Yang (U.S. Pat. No. 4,619,094). In Yang, the cap 22' has straight vertical outer sidewalls. This permits a second locking cap 26 to be slid down over the cap 22' thus preventing its outward deformation as necessary to snap off of the post 14. To prevent the locking cap 26 from coming off the cap 22', however, the cap 22' has a threaded member (not shown) formed into the top surface thereof into which a locking capscrew 28 is threaded through an aligned bore in the locking cap 26 provided for the purpose. The approach works; but, the complexity and cost of manufacture are high; and there are the small capscrews 28 to worry about losing. Additionally, if they rust in place, the anchor may no longer be easily disassemblable, as desired in the application.

As represented by the drawing of FIG. 3, Resan (U.S. Pat. No. 4,519,175) eliminated the necessity for the capscrew of Yang by directly threading the locking cap 26' onto the cap 22''. As can be seen from the figure, the interior of the locking cap 26' is threaded as are the straight vertical outer sidewalls of the cap 22''. The locking cap 26', rather than being slid on, is twisted on with the threads in engagement. For removal, it is simply unthreaded. That solved the problem of small and potentially rustable parts of Yang; but, it created problems of its own. The threaded parts are much more complex and costly to produce. The components of most of the anchors of the prior art are injection molded of plastic. The molds and attendant processes for producing threaded components are much more costly. Moreover, when initially installing a roof with the Resan anchors, the bottom portions are typically installed over the roof first with the caps 22'' in place ready for installation of the membrane. Given a short period of ungraded access, a few small boys can vandalize the entire roof by simply snapping off the caps 22'' and taking them.

FIG. 4, which represents the teaching of Hickman (U.S. Pat. No. 4,586,301) is an approach similar to that of Resan except that the cap 22'' with its external threads is replaced with metal clip 30 having outward facing fingers 32 at the bottom edge thereof which threadedly engage the interior threads of the locking cap 26'. The problems of Hickman are similar to those of Resan with the addition of metal components (i.e. the clip 30).

The only contrary approach is that of Tomszewski (U.S. Pat. No. 4,617,771) as depicted in FIG. 5. In this approach, the circular base 12' has a large circular depression 34 comprising the majority of the area. The depression 34 has an undercut peripheral edge 36. In use, the membrane 20 is disposed over the base 12' and a retaining ring 39 is urged into the depression 34 deforming the membrane ahead of it until both are positioned within the undercut peripheral edge 36. A circular locking plug 40 is then pressed into the depression 34 to lock the retaining ring 38 under the peripheral edge 36. The plug 40 has a peripheral groove 42 which snaps around the ring 38 intended to retain the plug 40 in the depression 34. While suitable under some conditions, of low profile, and aesthetically pleasing in appearance, the approach is generally unable to withstand any high force loads; that is, in a high wind creating a substantial upward peripheral force on the large, flat, plug 40, the plug 40 and ring 38 simply pop out releasing the membrane as in the case of the example of FIG. 1.

A further approach is found in Verble (U.S. Pat. No 4,658,558) which discloses an anchor for releasably anchoring a membrane to a surface comprising, a base member including means for attaching the base member to the surface, the base member includes a socket therein having a circular opening into the socket smaller in diameter than the diameter of the interior of the socket, the socket and opening being of sufficient diameter to have the membrane deformed through the opening and into the socket; and, a fastening member shaped to fit over the base member and the membrane with the membrane deformed into the socket, the fastening member including fastening means for inwardly deforming to pass through the opening and for thereafter outwardly expanding within the socket.

Wherefore, it is the object of the present invention to provide an anchor for use in releasably fastening a membrane to a surface such as a roof which is simple and of low cost to manufacture, requires no loose, small or metal parts, which firmly locks the membrane in place against high separation forces in use and which can be installed easily without special tools to install or remove it and without damage to the membrane.

Other objects and benefits of the present invention will become apparent from the detailed description thereof which follows hereinafter in combination with the drawing figures which accompany the description.

According to the invention there is provided an anchor for releasably anchoring a membrane to a surface comprising: (a) a base member including means for attaching said base member to the surface, said base member including a post thereon having a groove therearound, and (b) a fastening assembly shaped to freely fit over said base member with the membrane thereover, said fastening assembly including fastening means capable of inward deformation to cooperate with said groove with the membrane therebetween to captively hold said assembly on said base member and a deforming means to deform said fastening means inwardly into said cooperation and to maintain said cooperation.

Many buildings are built with plans to expand higher, adding a story or so a few years later. Owners have for a long time wanted a roof that could be reused. With the non-penetrating system of this invention, the roof can be completely removed, then reinstalled at the higher level saving thousands of dollars on materials.

This invention is unlike all other non-penetrating fasteners. The cap that holds the membrane does not forcefully contact the membrane covered post, secured to the substrate under the membrane, until the caps positioning is complete. All other systems known to Applicant have a piece of their cap that has to be forced against the membrane and the lower member under the membrane before it reaches its final position of engagement. This often causes the membrane to be damaged or punctured. Also, damaged or puncturing will occur in the event the system has to be removed, thus rendering the membrane unsuitable for re-use.

With the present invention there is always a clearance between the engagement cap and the membrane during installation or removal and this completely eliminates membrane punctures.

When the cap is in position a ring is forced into its final holding position by a drive pin plate as force is applied to the fastener pieces to complete the engagement. The membrane will not be punctured during installation or removal of the caps.

The present invention also has the advantage of a preassembled retained cap which in one step is installed.

Unlike all prior art membrane caps known to Applicant, the present invention fulfills all of the following requirements for such systems; namely:

1. To hold down the membrane against a 90 mph wind generated uplift force.
2. To hold down roof insulation at the same time as it provides anchors to hold down the membrane. This is a great labor saver.
3. To be non-penetrating to insure integrity of the system. (Penetrating caps cannot insure that the fastener screw will not be installed cross threaded, too loose, or strip threads by the installers).
4. To require no special devices required to install the caps. Devices damage the membrane occasionally when trying to force the caps on.
5. To be able to be installed in inclement weather. This will allow roofing companies to cut losses due to morning dew, frost, or sudden showers. It will also add labor days where workers can work on misty days or rain days.
6. To be simple to install and fast enought to keep labor cost down.
7. To require nor force fits. Force fits cause too much damage to the membrane.
8. To avoid unsightly wrinkles.
9. To extend over the membrane over the lower plate. Falling objects such as ice from higher roofs or workmen dropping tools near HVAC units cause damage to the membrane when the hard object strikes the membrane where the hard bottom plate is.
10. To avoid fingers or tines which may pinch the membrane.
11. To be easily removable to allow for repair near the cap or for removing the roof system for reroofing.
12. To be installed without friction between the membrane and cap or bottom plate.
13. To provide positive installation with no guess work.
14. To avoid the need for caulking.
15. To require only one single operation for the cap engagement.

Also the bottom plates to hold the insulation board must have a hump or post so the workers can located them after the membrane is stretched over the insulation and plates. Too low a profile will make locating the caps difficult.

DESCRIPTION OF THE PREFERRED EMBODIMENT

The four components of the present invention are shown individually in FIGS. 6, 8, 9 and 11. As will be instantly appreciated from these figures and FIGS. 7, 10, 12 and 13, the components are of simple construction which can be easily and economically formed entirely of plastic.

Figure 6:
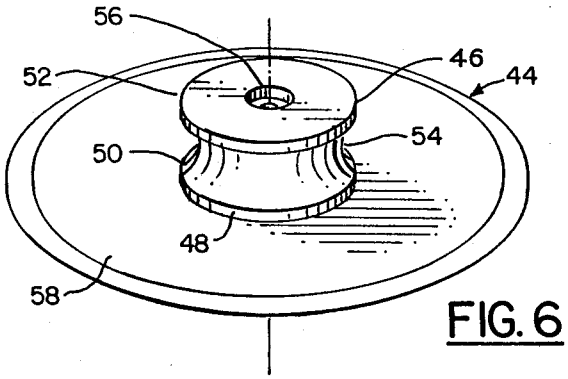
FIG. 6 is a perspective view of the base member of the present invention.

FIG. 6 depicts the base member, generally indicated as 44. The base member 44 comprises a generally cylindrical center post 46 having a circular base 48 and sidewall 50. The upper edge of the sidewall 50 has an outwardly facing bead 52 thus forming an annular groove 54 around the post between bead 52 and base 48. The base member 44 has a central bore 56 therethrough through which a screw, or the like, can be placed to fasten the base member 44 to the roof. In the preferred embodiment as depicted in FIG. 6, there is a thin substantially flat annular skirt portion 58 extending from the outer edge of base 48 at the bottom of post 46 outwardly.

Figure 1:
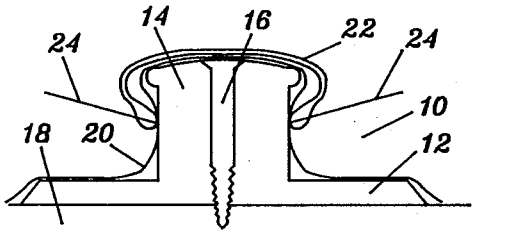
PRIOR ART Fig. 1
FIG. 1 is a simplified partially cutaway elevation drawing of a first prior art approach to a membrane anchor.
Figure 2:
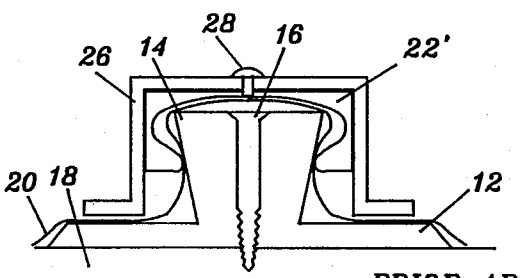
PRIOR ART Fig. 2
FIG. 2 is a simplified partially cutaway elevation drawing of a second prior art approach to a membrane anchor.
Figure 3:
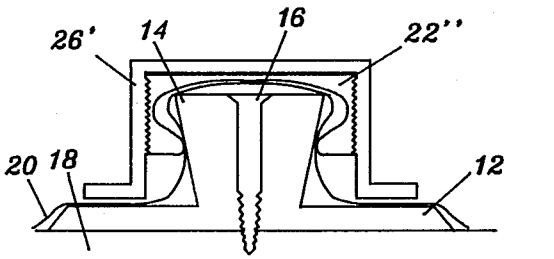
PRIOR ART Fig. 3
FIG. 3 is a simplified partially cutaway elevation drawing of a third prior art approach to a membrane anchor.
Figure 4:
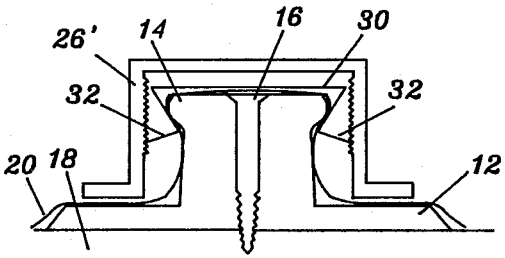
PRIOR ART Fig. 4
FIG. 4 is a simplified partially cutaway elevation drawing of a fourth prior art approach to a membrane anchor.
Figure 5:
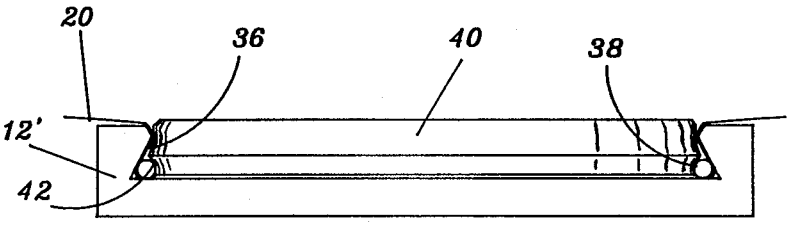
PRIOR ART Fig. 5
FIG. 5 is a simplified partially cutaway elevation drawing of a fifth prior art approach to a membrane anchor.
Figure 7:
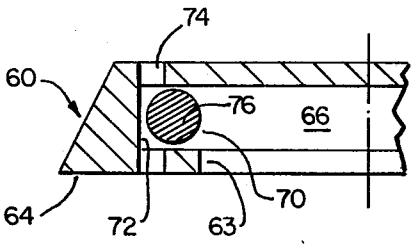
FIG. 7 is a cutaway partial side view of the fastening member of the present invention with the associated fastening ring in place.
Figure 8:
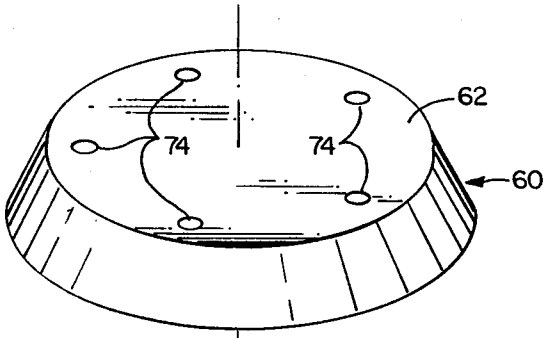
FIG. 8 is a perspective view of the fastening member of the present invention.

With reference now to FIGS. 7 and 8, the fastening member 60 has a frusto-conical shape with a flat circular upper surface 62 and an annular lower surface 64 defining a centrally located opening 66. Within the opening 66 formed in the circular wall 68 thereof is a fastening ring housing groove 70 of annular form surrounding the opening 66. The groove 70 defines a cylindrical outer wall 72. Five cylindrical bores 74 extend through the fastening member parallel with the axis thereof and adjacent cylindrical wall 72. These bores are equally spaced from and about that axis. The positioning of the bore 74 is such that a similarly sized cylindrical object positioned therein will extend through the groove 70 adjacent the wall 72. The opening 66 is sized to freely receive post 46 therein even when a roofing membrane is disposed over that post. This free reception permits the membrane anchor of the present invention to be assembled and disassembled without damage to a roofing membrane being anchored.

A resiliently radially deformable split ring 76 is housed in groove 17. This split ring 76 will be described in greater detail hereafter with respect to FIG. 11.

Figure 9:
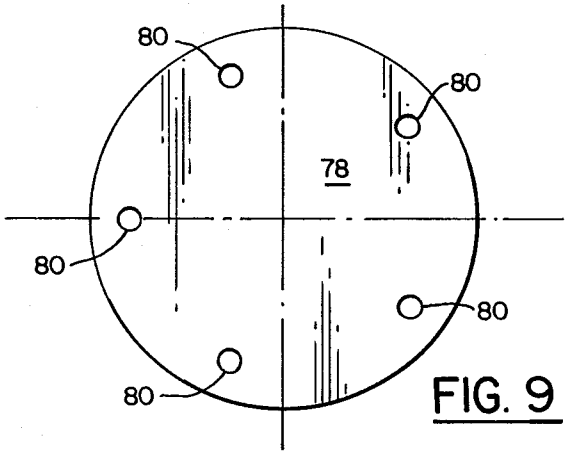
FIG. 9 is a bottom view of the ring deforming member of the present invention.
Figure 10:
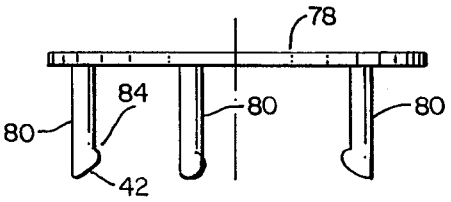
FIG. 10 is a side view of the ring deforming member of the present invention.

FIGS. 9 and 10 illustrate the ring deforming member 78. This ring deforming member comprises a circular plate 79 from one surface of which project five like posts 80 spaced to fit within bores 74 of the fastening member and of the length to pass through groove 70. Each post has a chamfered end 82 facing longitudinally outwardly and radially inwardly of member 78 to act as a cam surface to resiliently deform ring 76 inwardly as the posts are inserted through bores 74. Adjacent the cam surfaces facing radially inwardly of member 78 on each of the posts is a projection, notch or groove 84 positioned to engage the ring 76 when the ring deforming member 78 is positioned with posts 80 fully within their respective bores 74 (see FIG. 12). It will be appreciated that the present invention is not limited to five posts and bores.

Figure 11A:
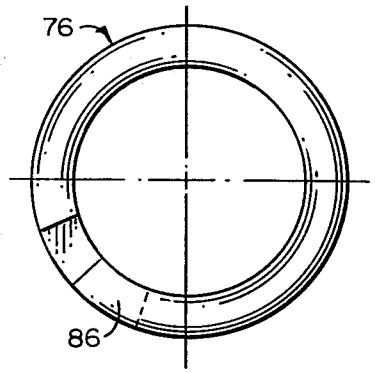
FIGS. 11A and 11B is a top view and a side view of the fastening ring of the present invention.
Figure 11B:
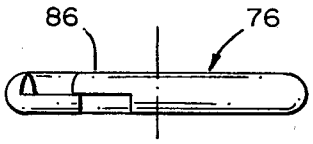

FIGS. 11A and B show ring 76 in its relaxed position, the same position in which it is shown in FIG. 7. Ring 76 is of circular cross-section and is split at 86 to permit the ring to decrease in diameter by telescoping overlapping movement of the split ends to reduce its effective diameter until it reaches the reduced diameter condition shown in FIG. 13. It will be appreicated that it is not essential for the present invention to utilize a split ring such as that shown in FIG. 11. A resiliently deformable toroidal ring (O-ring) could be utilized with this ring being deformed into a wavy circle by posts 80.

Figure 12:
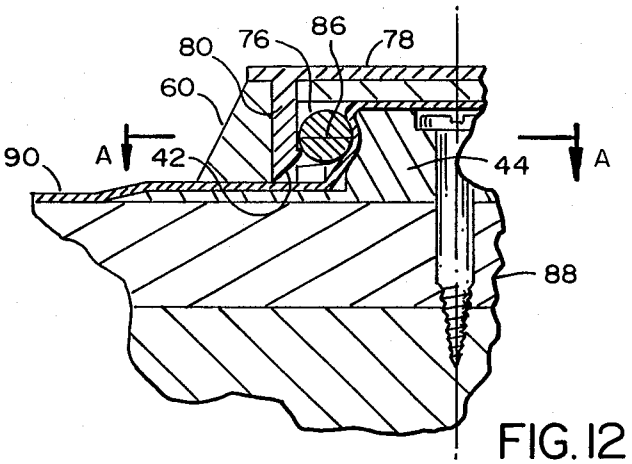
FIG. 12 a cutaway partial side view on Section line B—B of FIG. 13 of the base member of the present invention showing how the membrane is deformed when the fastening assembly is installed.
Figure 13:
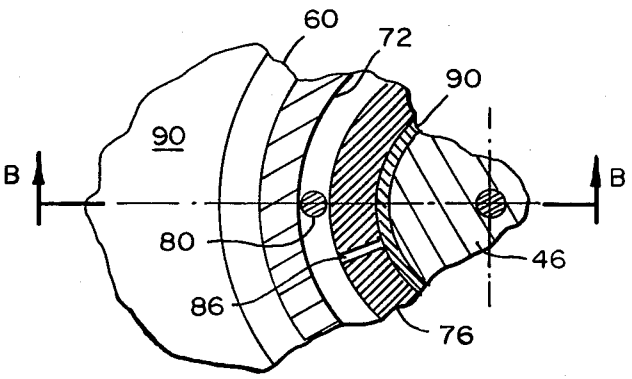
FIG. 13 is a cutaway partial plan view on Section line A—A of FIG. 12.

FIGS. 12 and 13 illustrate the anchor of the present invention in an assembled condition with the base member screwed to a roof structure through a layer of insulation 88. The roofing membrane 90 extends over the base member including its post 46. The fastening member 60 with ring 76 in place is placed over the post 46 without significant frictional contact with the membrane 90 and then the ring deforming member 78 is positioned over the fastening member with posts 80 passing into bores 74 so that the cam surface 42 of each post can inwardly deform the ring 76 to reduce its diameter thereby to press the membrane 90 into annular groove 54, the ring 76 being deformed inwardly sufficiently by the caming surfaces to hold the fastening member captive on the base member by virtue of the ring's location within groove 54. As noted above, the projections, notches or grooves 84 of posts 80 serve to hold the ring deforming member captive in the fastening member. To remove the anchor it is only necessary to pry the ring deforming member outwardly and upwardly to disengage the posts from the ring which will then revert to its relaxed position permitting the fastening member to be removed without damage to the membrane.

I claim:

1. An anchor for releasably anchoring a membrane to a surface comprising:

(a) a base member (44) including means for attaching said base member to the surface, said base member including a post (46) thereon having a groove (54) therearound, and (b) a fastening assembly including, as separate cooperating elements, a fastening member (60), a radially deformable ring (76) housed in a groove (70) in said fastening member (60) to freely fit over said base member with a said membrane (90) thereover when not deformed radially inwardly, said ring (76) being capable of inward deformation to cooperate with said groove with a said membrane therebetween to captively hold said assembly on said base member, and a deforming means (78, 80) arranged to cooperate with said fastening member (60) to deform said ring (76) inwardly into said cooperation and to maintain said cooperation.

2. The membrane anchor of claim 1 wherein said deforming means (78, 80) includes a plurality of posts (80) having ends defining cam surfaces (42), said posts being adapted to fit within bores (74) provided in said fastening member there to cooperate with said ring to cause said inward deformation thereof.

3. The membrane anchor of claim 2 wherein said posts are equally spaced about and from an anchor axis and are provided with means adjacent the cam surfaces to engage said ring to hold said deforming means captive in said assembly.

4. An anchor according to claim 2 wherein said ring is split and provided with overlapping ends to permit circumferential telescoping of the ends when a change in ring diameter is required.

* * * * *